US005381982A

United States Patent [19]

Adamski

[11] Patent Number: 5,381,982

[45] Date of Patent: Jan. 17, 1995

[54] BELTED SHEET TRANSFER DEVICE

[75] Inventor: Brian Adamski, Edgerton, Wis.

[73] Assignee: Beloit Technologies, Inc., Wilmington, Del.

[21] Appl. No.: 971,124

[22] Filed: Nov. 4, 1992

[51] Int. Cl.[6] ..... B65H 18/22

[52] U.S. Cl. ..... 242/541.3

[58] Field of Search ..... 242/65, 75.1, 66, 56 A, 242/56 R, 66

[56] References Cited

U.S. PATENT DOCUMENTS

| | | | |
|---|---|---|---|
| 1,992,114 | 2/1935 | Battison | 242/65 |
| 2,529,184 | 11/1950 | Pearson | 271/2 |
| 3,163,066 | 12/1964 | Beaulieu et al. | 242/56 R |
| 3,279,716 | 10/1966 | Huck | 242/56 A |
| 3,633,840 | 1/1972 | Clark | 242/56 |
| 3,883,084 | 5/1975 | Yamaguchi et al. | 242/56 R |
| 4,491,503 | 1/1985 | Adams et al. | 162/232 |
| 4,798,351 | 1/1989 | Halter et al. | 242/65 |

*Primary Examiner*—Daniel P. Stodola

*Attorney, Agent, or Firm*—Dirk J. Veneman; Raymond W. Campbell; Gerald A. Mathews

[57] ABSTRACT

An apparatus for starting the lead end of a traveling web on a core wherein an endless belt is carried on four rollers with two lower rollers carried on swinging arms which are pivotally spread to maintain a uniform tension in the belt and the rollers are supported on a carrier beam which is brought down to cause the belt to wrap the major portion of a core being wound. A cut lead end of a web is fed into the nip between the belt and the core, either by an air jet, a lifting finger or by the belt being brought in close proximity with the supporting drum so that the lead end of the web feeds into the nip between the belt and the core and is wrapped around the core for the full span that the belt wraps the core. The belt is maintained in contact with the roll, wrapping it as the roll builds up.

7 Claims, 4 Drawing Sheets

N-B
W
W-1
N

BELTED SHEET TRANSFER DEVICE

BACKGROUND OF THE INVENTION

The present invention relates to improvements in winders, particularly the type for winding a continuous web, such as of paper, onto a roll.

The invention relates to an improvement in a winding and reeling machine and one which is particularly successful in starting the lead end of a web onto a core. In a reeling or winding machine for continuously winding web material without interruption on successive drum supported cores, it is necessary at the completion of the winding of one roll to provide a roll changing device which will positively transfer the web onto a new roll. A new roll is started by cutting the tail end of the web from the previous roll and guiding or leading the cut end onto a core to start the new roll. This is done by a portion of the web being directed into a nip point created usually between a lay-on roll and a new core.

Typical web transferring devices that operate on a core-supported wind-up without interruption of the web rely on air jets or tape to separate the sheet from the drum onto the new core. Air jet transfers frequently produce unkept transfers inasmuch as wrinkles and fold-overs form in the unsupported web before completing the initial wrap. These, of course, will affect successive layers generating an uneven start to the new roll.

In the use of tape, tension by an operator is necessary, and this method is frequently unsafe and often will contaminate the mill repulping system with non-repulpable tape getting into the system. The tape arrangement also produces conical shaped rolls because it utilizes a web winding widening technique for starting the web onto the new core. Both the air transfer and the tape transfer methods are detrimental to the roll structure near the core.

Non-uniformities in diameter adversely affect the use of nip pressure to produce uniform cross-machine wound-in tension. Layers on a roll which are wrapped with different tension levels produce web defects often in the nature of corrugations. Also, circumferential web tension produced near the core is reduced as subsequent web wraps are introduced onto the roll. It is critical that the initial wraps are wound tightly enough to remain in tension and prevent layer-to-layer slippages as the roll builds. Improper or unsatisfactory winding on the core with the initial start minimizes salable web material. Also, if a transfer onto the core is missed, the high speed of operation results in a gigantic pile-up of paper which is waste and must be transferred to the broke, and expensive shut-down time occurs. When the transfer is made successfully, but the initial winding is improper because of improper tension or because of corrugations, it is common experience that the first two to five radial inches of material must be scrapped by the user due to web defects caused by sloppy transfers. Transfer efficiency in devices presently available is often less than 90%.

It is, accordingly, an object of the present invention to provide a roll changing device and method which will positively transfer the web onto a new roll avoiding failures in transfer and avoiding inadequate transfer which damages the paper on the initial winding of web onto a roll.

A further object of the invention is to provide a web winding transfer apparatus for starting a web on a core that insures a smooth and complete first wrap with the wrapping continuing around the core without wrinkles and corrugations and at uniform desired web tension.

A still further object of the invention is to provide an improved reeling or winding machine with improved web control wherein the initial lay-on of the web on a new core is carried out smoothly and control of the new winding roll is continued.

SUMMARY OF THE INVENTION

The present invention and arrangement is provided to transfer an uninterrupted web cleanly and positively onto a new core. The web, or portion of the web, is guided immediately after separation from the trailing end of the previously wound roll, and positive control of the lead end of the new severed end is maintained until the first wrap is completed. Essentially, the web is constrained around the entire circumference of the new core. A continuous belt is provided which is lowered over the core and driven by the core, or separate belt drive, and provides a nip point between the core and belt closely adjacent the supporting drum with a positive web support immediately initiated and maintained over substantially the full circumference of the core. The web preferably is divided into a narrow cross-machine section aligned with the belted web guide upstream of the cores on the core support drum. As a portion of the web is separated, it is fed into the nip point between the belt and the core with positive control and the belt extends around the major portion of the core holding the web between the belt and core, and the transfer is completed by tearing or cutting of the web over its full width to begin the wrap over the core with the full web. Uniform cross-machine nip pressure distribution between the core and support drum is obtained and a more uniform profile of the web being wound onto the core is obtained.

The belted device also provides a more uniform cross-machine nip pressure profile. Typically, the core is heavily end-loaded, deflecting the core off the support drum surface near the center. The device provides a portion of nip presure between the drum/core nip at the core centerline, similar to the rider roll's function on two-drum and bi-wind winders. The cross-machine nip pressure profile is more uniform, resulting in better roll structure and increased turn-up efficiencies.

With the addition of a separate belt drive, a similar configuration could be used to accelerate the core to machine speed and maintain contact with the core until it was positively driven through the nip by the support drum. Currently, the core is accelerated to machine speed with a drive which loses contact with the core after it is rotated slightly. Consequently, the core begins to decelerate until it is brought into nipping engagement with the driven support drum. If the core is not closely speed matched with the web when the nip is made, the web is severed. Typically, the core is over-sped to compensate for this deceleration. However, different cores exhibit different amounts of bearing and windage friction.

BRIEF DESCRIPTION OF THE DRAWINGS

Other objects and advantages and features, as well as the equivalent structures and methods which are intended to be covered herein, will become more apparent with the teaching of the principles of the invention in connection with the disclosed embodiments thereof in the specification, claims and drawings, in which:

DESCRIPTION OF THE PREFERRED EMBODIMENTS

Figures 1, 2, 3:
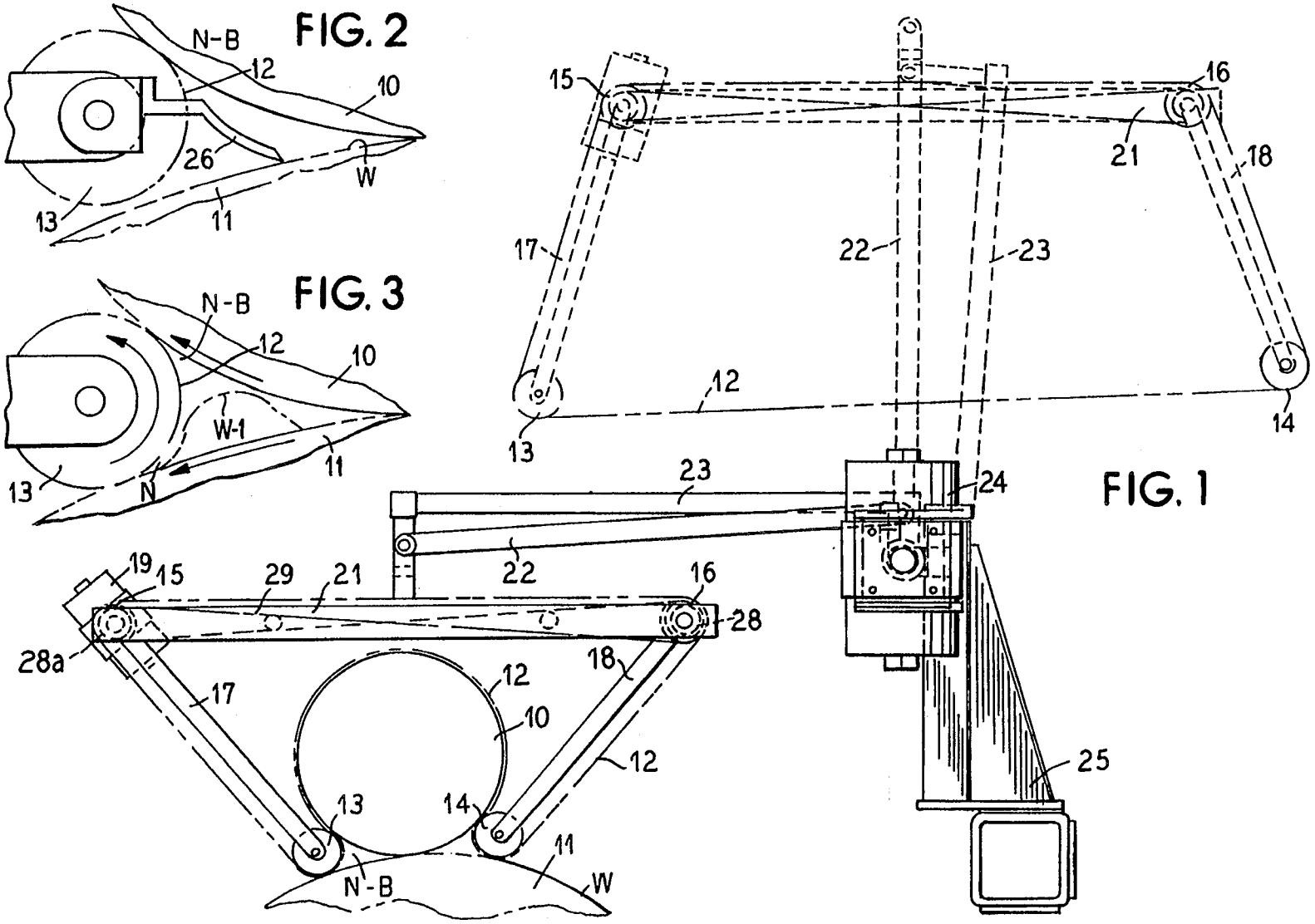
FIG. 1 is a side-elevational illustration of a winding machine with a transferring apparatus constructed in operating in accordance with the principles of the present invention.
FIG. 2 is a fragmentary elevational view illustrating one type of mechanism for deflecting the lead end of the web into the belt nip.
FIG. 3 is a fragmentary elevational view illustrating another manner of directing the lead end of the nip into the belt nip.

As illustrated in FIG. 1, a core 10 to be wound is shown in frictional drive relationship with a supporting drum 11. A web W is being wound over the periphery of the drum which is wrapped with a belt 12. The belt is maintained under a predetermined tension and, as will be observed in FIG. 1, wraps the major portion of the core 10.

The wrapping belt 12 is carried on a plurality of rollers with a lower main roller shown at 13 and 14, which are preferably slightly crowned. To complete a quadrilateral support for the belt, upper rollers are provided at 15 and 16 so that the endless belt travels over the rollers. The belt is driven in its travel by contact with the core, or by a separate drive, so that as the core is placed in position and starts in rotation by contact with the drum 11, the belt is brought down over the core so that the linear speed of the belt, the surface speed of the drum and the surface speed of the core are all the same.

The lower rollers 13 and 14 are carried on swing arms 17 and 18. The upper ends of these swing arms are mounted on a cross beam 21 which is maintained horizontal. The beam is supported for being maintained horizontal by laterally extending arms 22 and 23. These arms are moved from the solid line position to the dotted line position of FIG. 1 by a power mechanism 24. As the roll builds up, the swing arms will move apart to accommodate the increased diameter of the roll and will raise up supported on the beam to the position shown in FIG. 6.

A uniform predetermined tension is maintained in the belt by a torsion spring apparatus 19. The torsion spring apparatus supplies a rotary torque to a sprocket 27, FIGS. 1 and 7. The two swing arms 17 and 18 are mounted on shafts which are rotated by sprockets 27 and 28. These sprockets are interconnected by a crossed chain 29 which insures that each of the swing arms 17 and 18 swing outward and inwardly together to maintain the same vertical angle as indicated by the arrowed lines in FIG. 7. The torsion spring 19 applying a torque in a counter-clockwise direction to the sprocket 27 tends to force both swing arms outwardly to maintain a tension in the belt. Thus, the lower rollers 13 and 14 will begin by riding against the core and will continue to ride on the surface of the roll as it builds up to the position of FIG. 6. The supports arms 22 and 23 will apply slight downward force to maintain the wrap of the belt over the core in the position of FIG. 6 as the roll builds. The web W rides on the surface of the support drum 11 and onto a roll 20 being wound on the core 10. The support arms 22 and 23 are positionally controlled by the power mechanism 24 which is supported on a framework 25.

For initiating the winding onto a core, a core is positioned on the support drum 11 by a mechanism, not shown, and the endless belt 12 is then brought down over the core and all elements are brought up to surface traveling speed for transferring of the lead end of a web. The web W, of course, is traveling over the surface of the support drum 11, and a lead end must be cut from the web to be started onto the core. A mechanism for cutting the lead end is shown in FIG. 8.

Figure 8:
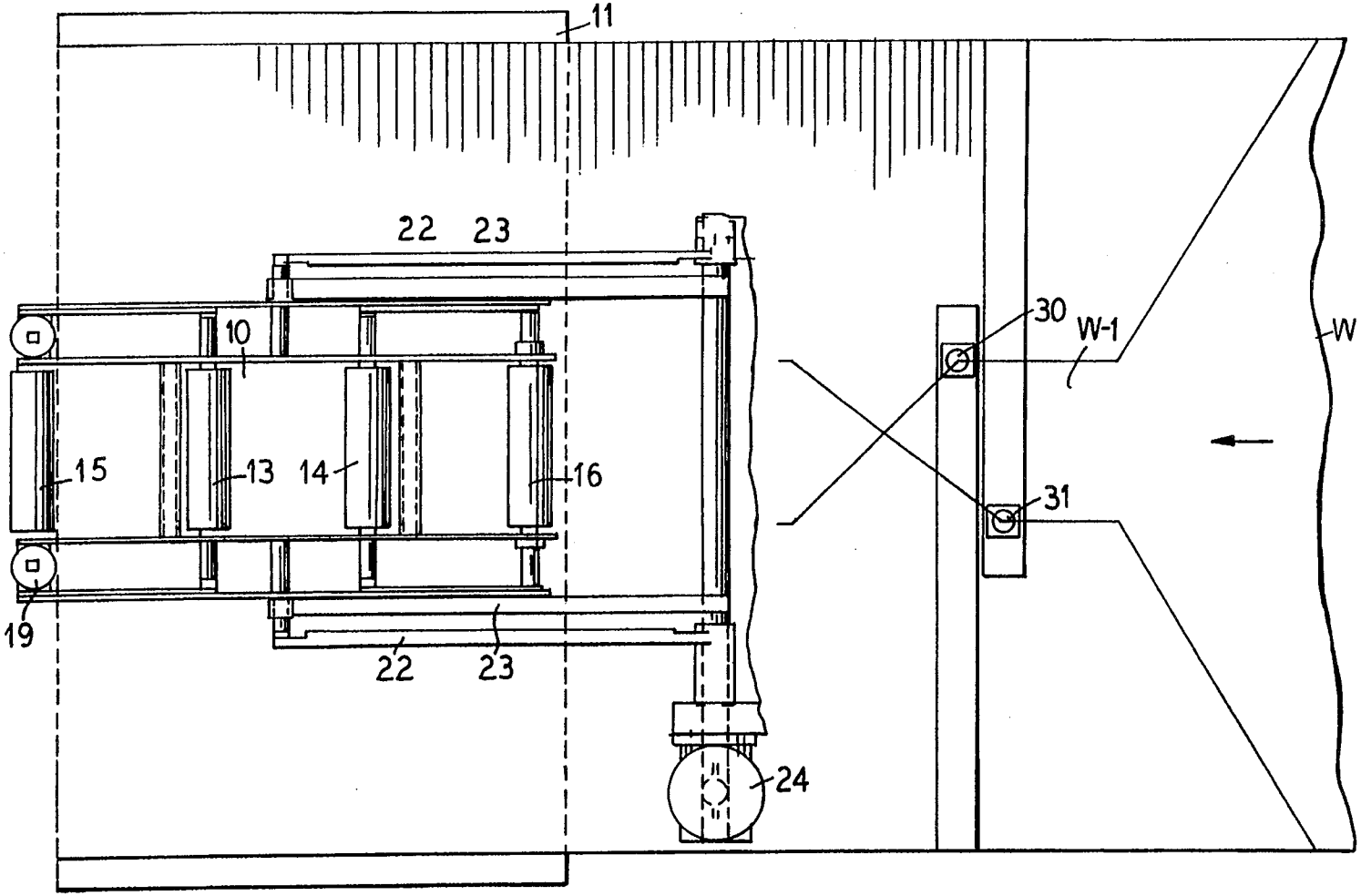
FIG. 8 is a plan view in somewhat schematic form illustrating cutting the lead end of the web to be wound on a core.

As shown in FIG. 8, a traveling web approaches the supporting drum 11, and a lead end W-1 is cut by a cutting means, such as water jets 30 and 31. The lead end passes onto the drum 11 to be wrapped on the spinning core 10. A nip N-B (FIGS. 1–5) is formed between the belt 12 and the core 10. To draw up the lead end of the web W-1 into the nip N-B, several arrangements may be employed, such as those illustrated in FIGS. 2, 3 and 5.

Figure 6:
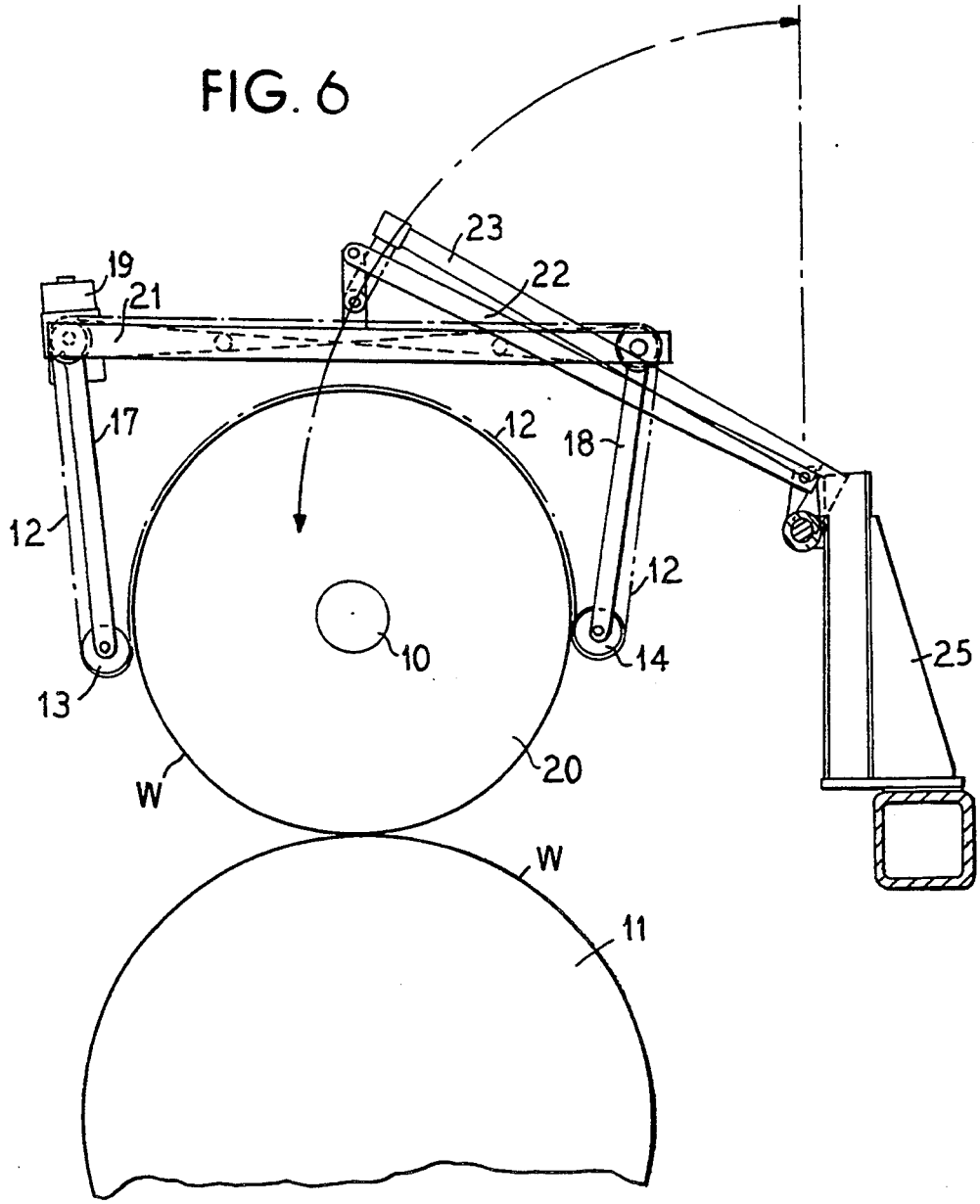
FIG. 6 is a somewhat schematic elevational view illustrating the position of the apparatus as the roll builds in size.
Figure 7:
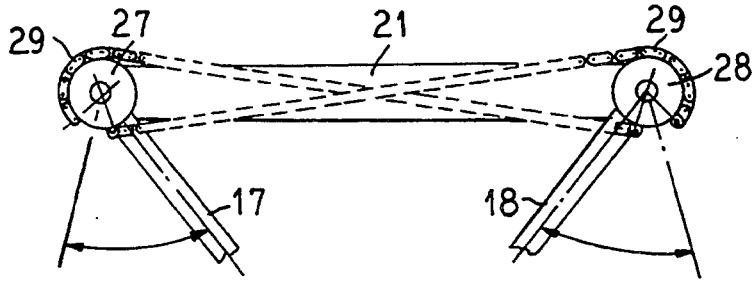
FIG. 7 is a somewhat schematic elevational view illustrating one form of maintaining tension in the belt.

In FIG. 2, knife, or lifting finger, 26 may be employed as a guide to catch the lead relatively narrow end and direct it upwardly in the nip N-B. The lead end will immediately be firmly trapped and held between the belt 12 and the outer surface of the core 10 and carried out fully around the core 10. It will be apparent from FIG. I that a positive control of the web is obtained, and the web will be laid smoothly over the surface of the core. The lead end of the web will continue on traveling around the core, and a smooth, continuing reeling will occur without causing any wrinkles or corrugations. The remainder width of the web is then cut or torn so that the entire width of a web is wound over the core. The wrapping endless belt 12 continues to surround the core and continues to control the position of the core in the winding roll on the support drum as the sides of the winding wound web roll 20 builds up, as shown in FIG. 6.

In the arrangement of FIG. 3, the swing arms are positioned slightly closer to the surface of the drum 11 so that frictional engagement occurs between the belt 12 and the approaching web. This will tend to push the web up in a loop, as shown as W-1, so that the lead end will be caught in the nip N-B between the belt 12 and the surface of the core 10. Except for a fold at the lead end, the web will be as smoothly held and wrapped over the surface of the core.

Figures 4, 5:
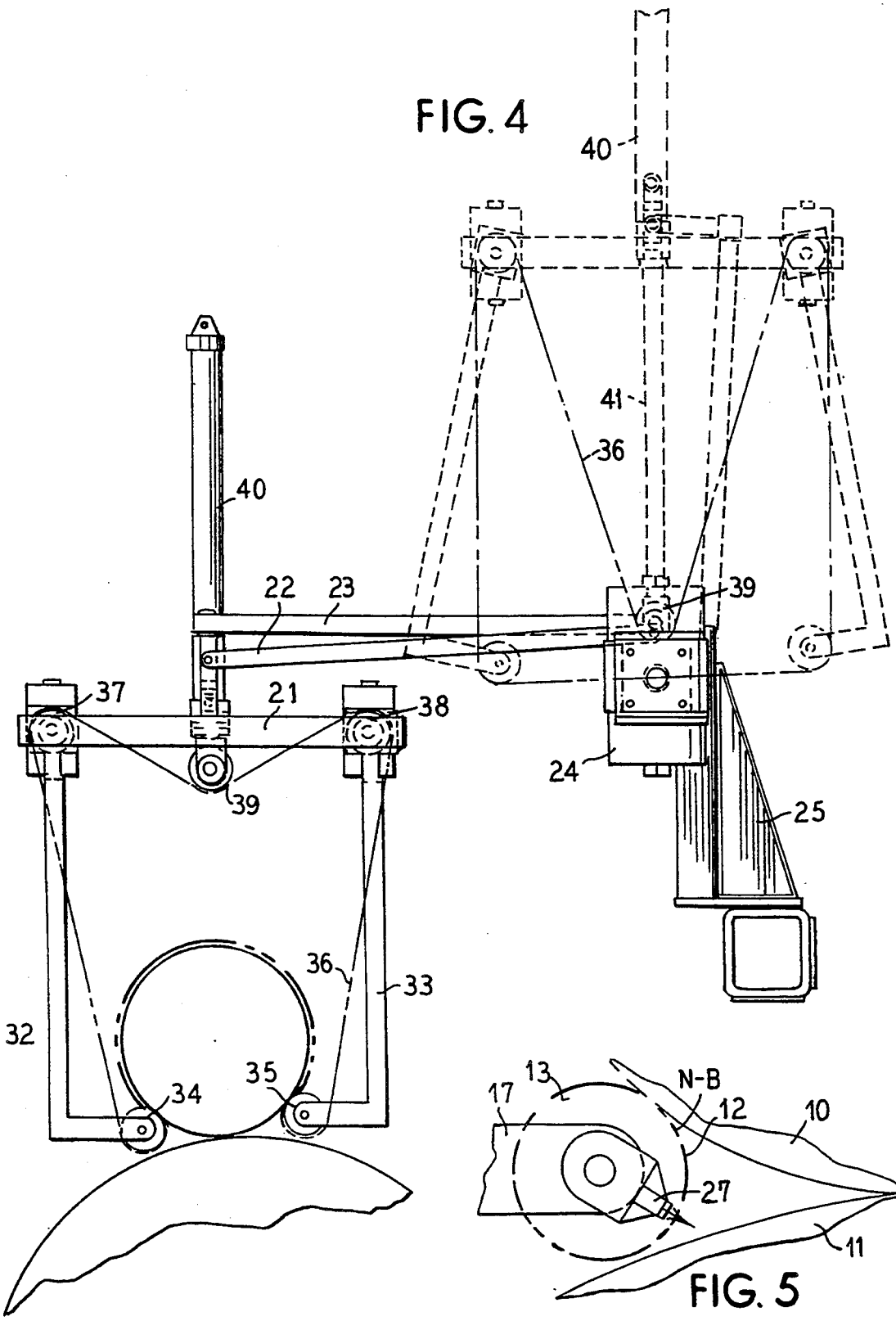
FIG. 4 is a somewhat schematic elevational view illustrating another form of the apparatus first illustrated in FIG. 1.
FIG. 5 is a fragmentary elevational view illustrating another manner of directing the lead end of the web into the belt nip.

In the arrangement of FIG. 5, an air jet 27 is carried by the swing arm 17 and the lead end of the web is lifted up off of the drum 11 into the nip N-B so that winding of the core starts smoothly.

It will be seen that regardless of the position of the swing arms, the belt is maintained under a predetermined tension and the tensioning device 19, in combination with the endless chain 29 acting on the sprockets 28 and 28*a*, tends to urge the swing arms 17 and 18 toward each other.

In the arrangement of FIG. 4, a modified form of maintaining predetermined tension in the belt is shown. In this arrangement, swing arms 32 and 33 are provided having first, or lower, rollers 34 and 35 at their lower end supporting an endless belt 36. Upper rollers 37 and 38 carry the upper end of the belt.

A tensioning roller 39 faces downwardly in the belt span between the upper rollers 37 and 38. This tensioning roller 39 is urged downwardly by a piston rod 41 connected to a cylinder 40. In the operative position, which is the solid line position of FIG. 4, the tensioning roller 39 is in an upper position maintaining a tension on the belt 36. When the roll has been completed and prior to the installation of the new core, the equipment is in the upright position, shown in the dotted line position of FIG. 4, and the piston 41 is extended to cause the roller 39 to maintain tension in the belt 36.

The apparatus for supporting the looped belt and for moving it into, and out of, operating position is collectively referred to as a carrier. Includes the various rollers, arms, swing arms, belt tensioning devices, beams, chains, sprockets and power devices.

In operation, with reference to FIG. 1, a core 10 is positioned on the support drum 11 and the endless belt 12, with the span extending between the rollers 13 and 14 brought down over the core. The friction between the core and the support drum 11 brings the core up to rotational speed, and the belt 12 brought down over the core, or separate drive, brings the belt up to traveling speed. The lead end of a web W is then pushed up into the nip N-B between the belt and the core by a devices such as shown in FIGS. 2, 3 or 5. The lead end of the web is then controllably captured between the surface of the core 10 and the belt 12 so that the lead end is smoothly carried around the major part of the circumference of the core and continues to wind smoothly over the core. The belt is held on over the winding roll helping to insure smooth winding and helping to control the position of the winding roll on the support drum 10 so that the diameter of the roll builds up as shown in FIG. 6. When the roll is fully wound, the support beam 21 is lifted by the arms 22 and 23 and the wound roll 20 is moved away by other equipment, not shown. The new core is positioned against the support drum 11 ready to capture the lead end of a web which is formed by a cutting mechanism shown in FIG. 8. The lead end is then wound onto the core in a manner shown in FIG. 1 so that a new roll is started and this operation is repeated successively with the transfer of the web from a completed roll to a new core being under complete control, eliminating failures in transfer which have occurred with apparatus heretofore available. This has been accomplished with the minimum attention of the operator, and smooth initial wrap over the core is ensured. The quality of the web first wound on the core is maintained so that the initial wrapped paper web over the core does not have to be discarded because of web defects, such as wrinkles and corrugations and non-uniform uncontrolled tension.

As will be seen, there has been provided an improved web transfer arrangement which meets the objectives and advantages above set forth and provides a simplified reliable web transfer and winding arrangement.

I claim as my invention:

1. In a winder for starting the winding of a continuous traveling web onto a core supported on a rotary driving drum to form a wound web roll, the combination comprising:

a carrier, including a cross beam;

an endless belt having an outer surface for nipping the core for receiving the traveling web in the nip to be started for winding into a wound web roll on the core;

a first pair of spaced rollers mounted on the carrier defining a core-embracing span between them with said belt looped over said rollers;

a second pair of spaced rollers supporting the belt and mounted at spaced locations on the carrier;

a pair of pivotal swing arms extending downwardly from the carrier cross beam with said first spaced rollers mounted on the distal ends of the pivotal swing arms;

and means for lowering the carrier so that the first spaced rollers bring said belt to wrap the core with the belt span for creating a nip with the core for winding the core with the traveling web.

2. In a winder for starting the winding of a continuous traveling web onto a core supported on a rotary driving drum, the combination constructed in accordance with claim 1:

wherein the carrier includes a primary pivotable arm supporting said carrier cross beam and movable for maintaining a controlled tension in the belt.

3. In a winder for starting the winding of a continuous traveling web onto a core supported on a rotary driving drum, the combination constructed in accordance with claim 1:

including belt tensioning means connected to the arms for maintaining a predetermined spreading force to the arms to maintain a predetermined tension in the belt.

4. In a winder for starting the winding of a continuous traveling web onto a core supported on a rotary driving drum, the combination constructed in accordance with claim 1:

further including a pivotal support arm means connected to the carrier for moving the carrier cross beam downwardly for the belt to embrace the core.

5. In a winder for starting the winding of a continuous traveling web onto a core supported on a rotary driving drum, the combination constructed in accordance with claim 4:

including tensioning springs connected with the carrier and swing arms for applying a spreading force to the arms for maintaining a predetermined tension in the belt.

6. In a winder for starting the winding of a continuous traveling web onto a core supported on a rotary driving drum, the combination constructed in accordance with claim 1:

further including a tensioning roller supported on the carrier applying a tensioning force to the endless belt for maintaining a predetermined constant tension in the belt.

7. In a winder for starting the winding of a continuous traveling web onto a core supported on a rotary driving drum, the combination constructed in accordance with claim 6:

including a fluid piston and cylinder for applying the tensioning force to the tensioning roller.

* * * * *